US006185773B1

(12) United States Patent
Goedde

(10) Patent No.: US 6,185,773 B1
(45) Date of Patent: Feb. 13, 2001

(54) REMOTE CONTROL MECHANISM FOR A LOCKER

(76) Inventor: Kirby R. Goedde, 10938 N. 450 East, Morristown, IN (US) 46161

( * ) Notice: Under 35 U.S.C. 154(b), the term of this patent shall be extended for 0 days.

(21) Appl. No.: 09/520,009

(22) Filed: Mar. 6, 2000

(51) Int. Cl.[7] ..... G08B 21/00

(52) U.S. Cl. ..... 7/540; 340/825.31; 340/825.32; 340/825.19; 340/545; 340/547; 340/540

(58) Field of Search ..... 340/825.31, 825.32, 340/825.19, 545, 547, 426, 825.34, 825.69, 825.72

(56) References Cited

U.S. PATENT DOCUMENTS

| | | | | |
|---|---|---|---|---|
| 4,778,206 | | 10/1988 | Motsumoto et al. | 70/263 |
| 5,021,776 | | 6/1991 | Anderson et al. | 340/825.31 |
| 5,261,260 | | 11/1993 | Lin et al. | 70/280 |
| 5,384,495 | * | 1/1995 | Waggamon et al. | 307/326 |
| 5,392,025 | | 2/1995 | Figh et al. | 340/545 |
| 5,406,274 | | 4/1995 | Lambropoulos et al. | 340/825.69 |
| 5,678,436 | | 10/1997 | Alexander | 70/278 |
| 5,680,134 | | 10/1997 | Tsui | 341/173 |
| 5,790,065 | * | 8/1998 | Yaroch | 341/173 |
| 5,894,277 | | 4/1999 | Keskin et al. | 340/825.31 |
| 5,896,094 | | 4/1999 | Narisada et al. | 340/825.31 |
| 5,903,216 | * | 5/1999 | Sutsos et al. | 340/542 |
| 5,933,086 | * | 8/1999 | Tischendorf et al. | 340/825.31 |
| 5,987,818 | * | 10/1998 | Dabideen | 49/280 |

FOREIGN PATENT DOCUMENTS

| | | |
|---|---|---|
| 2 078 845 | 1/1982 | (GB) . |
| 2 159 567 | 12/1985 | (GB) . |

* cited by examiner

*Primary Examiner*—Jeffery A. Hofsass
*Assistant Examiner*—Hung Nguyen
(74) *Attorney, Agent, or Firm*—Richard C. Litman

(57) ABSTRACT

A school locker having remote controlled locking, opening, and beeping functions. The locker includes a key pad transmitter having a first button that activates a locking mechanism, a second button that activates a door opening mechanism, and a third button that activates a sound-making device, much like the beeper in a wristwatch, in order to help a visually impaired student more easily find his or her locker. Two embodiments of the locking mechanism are presented, the first being a solenoid actuated remote control locking mechanism, and the other being a remote controlled motorized pendulum lock. Again, the second feature of the locker is a door opening device, which may be used in connection with either locking mechanism, and which opens the locker door after it is unlocked. The door opening mechanism utilizes a solenoid actuated system of release levers which urge the locker door's latch pins off of their corresponding latches. One electrical circuit is used for the locking mechanisms and the door opening device, and a different circuit is used for the beeping function of the locker.

6 Claims, 8 Drawing Sheets

REMOTE CONTROL MECHANISM FOR A LOCKER

BACKGROUND OF THE INVENTION

1. Field of the Invention

The present invention relates generally to student lockers, and more specifically, a locker having remote control locking, opening, and noise-making mechanisms operable by a key chain transmitter.

2. Description of the Related Art

Electronic locking systems for lockers have been the subject of earlier patents. Handicapped persons, especially students in wheelchairs need to be able to locate, unlock, and open their school lockers by remote control. The related art will be discussed in the order of perceived relevance to the present invention. The related art of interest describes various locks, but none disclose the present invention as claimed.

U.S. Pat. No. 5,894,277, issued in April 1999 to Keskin et al., describes a programmable digital electronic lock for a locker. The lock may be opened using a keypad that is permanently mounted to the locker door. Keskin discloses only a solenoid locking mechanism but not the higher efficiency pendulum lock. Moreover, Keskin does not disclose a locker assembly having separate mechanisms that cooperate to both unlock and then open a locker; nor does Keskin a keypad that can signal and cause the triple function of beeping, unlocking, and opening, in distinct intervals. Thus Keskin does not disclose the present invention as claimed.

U.S. Pat. No. 5,933,086, issued in August 1999 to Tischendorf, et al., describes a keyless locking mechanism, with a portable remote to lock and to unlock a house door. The Tischendorf device is not suited to a gym locker and it lacks both the structure and functionality of the present invention.

U.S. Pat. No. 5,678,436, issued in October 1997 to C. E. Alexander, describes a remote control door lock system to remotely lock and unlock the deadbolt on a door. The Alexander device lacks the structure, combination of components, and functionality of the present invention.

United Kingdom Application No. GB 2,159,567, published in December 1985, describes a storage container that unlocks with the use of a remote control. However, the '567 does not disclose a storage receptacle that both unlocks and opens with the remote control, just one that unlocks with the remote control. Nor does it have the additional features such as a release lever, pendulum lock to increase efficiency, or the noise-making mechanism.

Other patents which have some relevance to the present invention include: U.S. Pat. No. 4,778,206, issued October, 1988 to Motsumoto, et al.; U.S. Pat. No. 5,021,776, issued September, 1991 to Anderson, et al.; U.S. Pat. No. 5,261,260, issued November, 1993 to Lin, et al.; U.S. Pat. No. 5,392,025, issued February, 1995 to Figh, et al.; U.S. Pat. No. 5,406,274, issued April, 1995 to Lambropoulos, et al.; U.S. Pat. No. 5,680,134, issued October 1997 to Tsui, P. Y., U.S. Pat. No. 5,896,094 issued April, 1999 to Narisada, et al.; and United Kingdom Patent Application No. GB 2,078,845 published February, 1982.

None of the above inventions and patents, taken either singularly or in combination, is seen to describe the instant invention as claimed. Thus, there is a need for a remotely controlled school locker that is operable by a transmitter on a key chain, and that has one or more, or a combination of the features of the present invention in order to solve the problems of efficiency, security, and versatility.

SUMMARY OF THE INVENTION

The present invention is a remote control mechanism for a storage locker, such as those used in fitness centers, school gymnasiums, employee changing areas, etc. The mechanism, designed especially for handicapped students or employees, enables a locker to be located by an audible signal, unlocked and opened by remote control via a handheld transmitter. The locker assembly includes a transmitter having a first button that activates a door locking mechanism, a second button that activates a door opening mechanism, and a third button that activates a sound-making device, much like the beeper in a wristwatch, in order to help a visually impaired student more easily find his or her locker.

The mechanism includes a receiver that receives signals from the transmitter and which responds to commands that actuate the door locking mechanism, the door opening mechanism, and the noise-making mechanism. Two embodiments of the remote control locking mechanism are presented, the first being a solenoid actuated remote control locking mechanism, and the other being a remote controlled motorized pendulum lock that uses less energy than the solenoid mechanism. The door locking mechanism is particularly useful for students who are visually impaired or who have problems with manual dexterity and are unable to operate the conventional combination lock, enabling them to unlock the locker by remote control and thereafter opening the locker by lifting the handle on the locker door. The door opening mechanism is particularly useful for students who are confined to a wheelchair, and enables them to both unlock and open the locker door by remote control before moving the wheelchair up to the locker.

As stated, the second primary feature of the locker is a door opening device, which may be used in connection with either embodiment of the door locking mechanism. The door opening mechanism unlocks and opens the locker door. The door opening mechanism utilizes a method of lifting the locker door latch pins using a remote controlled, solenoid actuated system of release levers. A cable connecting the solenoid to the release levers causes the levers to rotate about a fulcrum, which urges the locker latch pins off of their corresponding latches.

Similar circuits, each having slightly different values, are used for both the locking mechanisms, and the door opening device. A different circuit is used for the beeping function of the locking mechanism.

Accordingly, it is a principal object of the invention to provide a device that provides students with disabilities, and other students, convenient access to their school lockers.

It is another object of the invention to provide a useful device to employers who offer employee lockers, by providing the option to furnish a locker that can serve the needs of a broader spectrum of employees, most notably those who are disabled or handicapped.

It is a further object of the invention to provide an efficient and versatile locker assembly that can be operated using a remote controlled, handheld, push button device.

It is an object of the invention to provide improved elements and arrangements thereof for the purposes described which is inexpensive, dependable and fully effective in accomplishing its intended purposes. These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
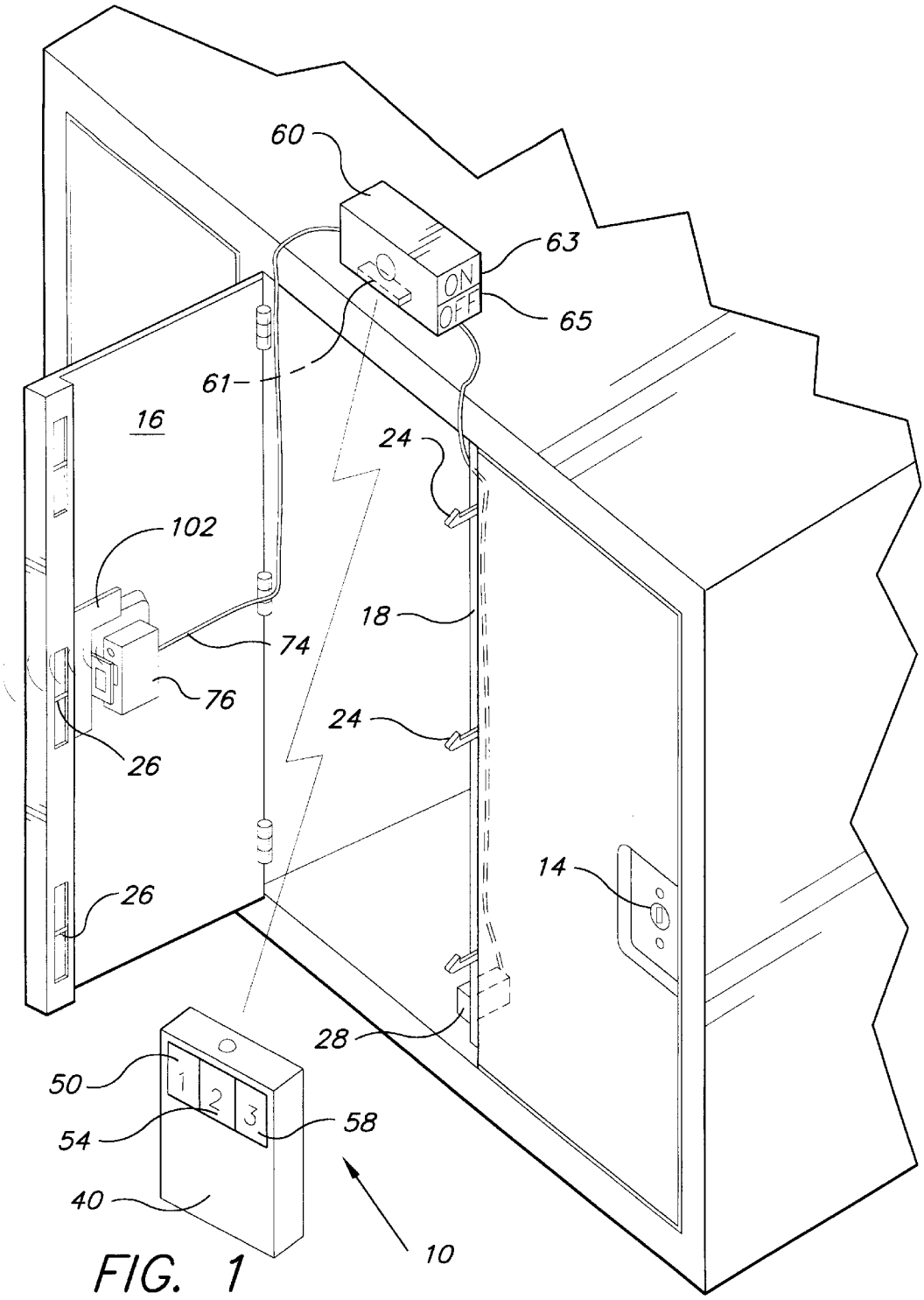
FIG. 1 is a front perspective view of a generic embodiment of an automated locker according to the present invention.
Figure 5:
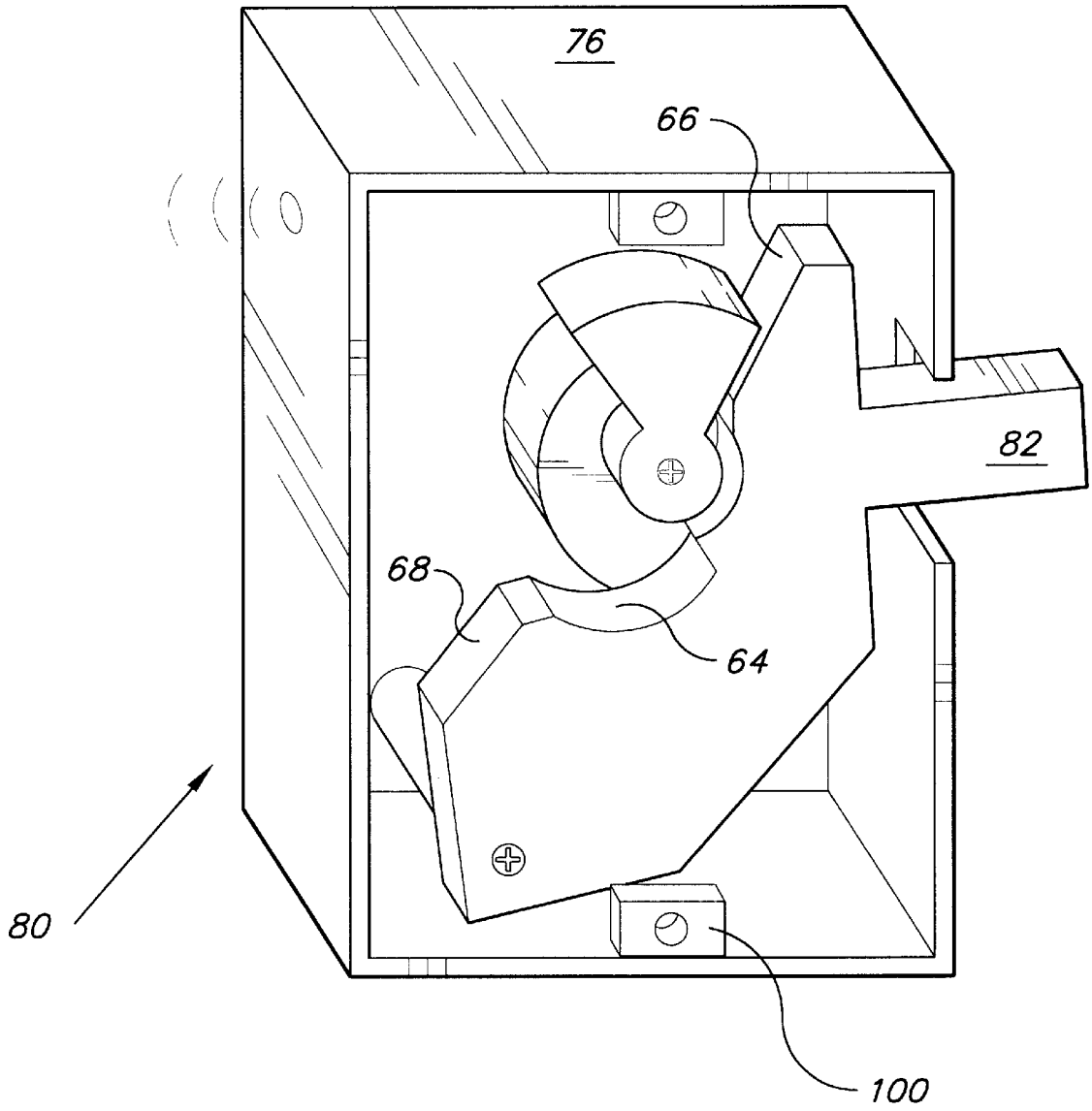
FIG. 5 is a front perspective view of the second embodiment of the automated door locking mechanism in an unlocked position.
Figure 6:
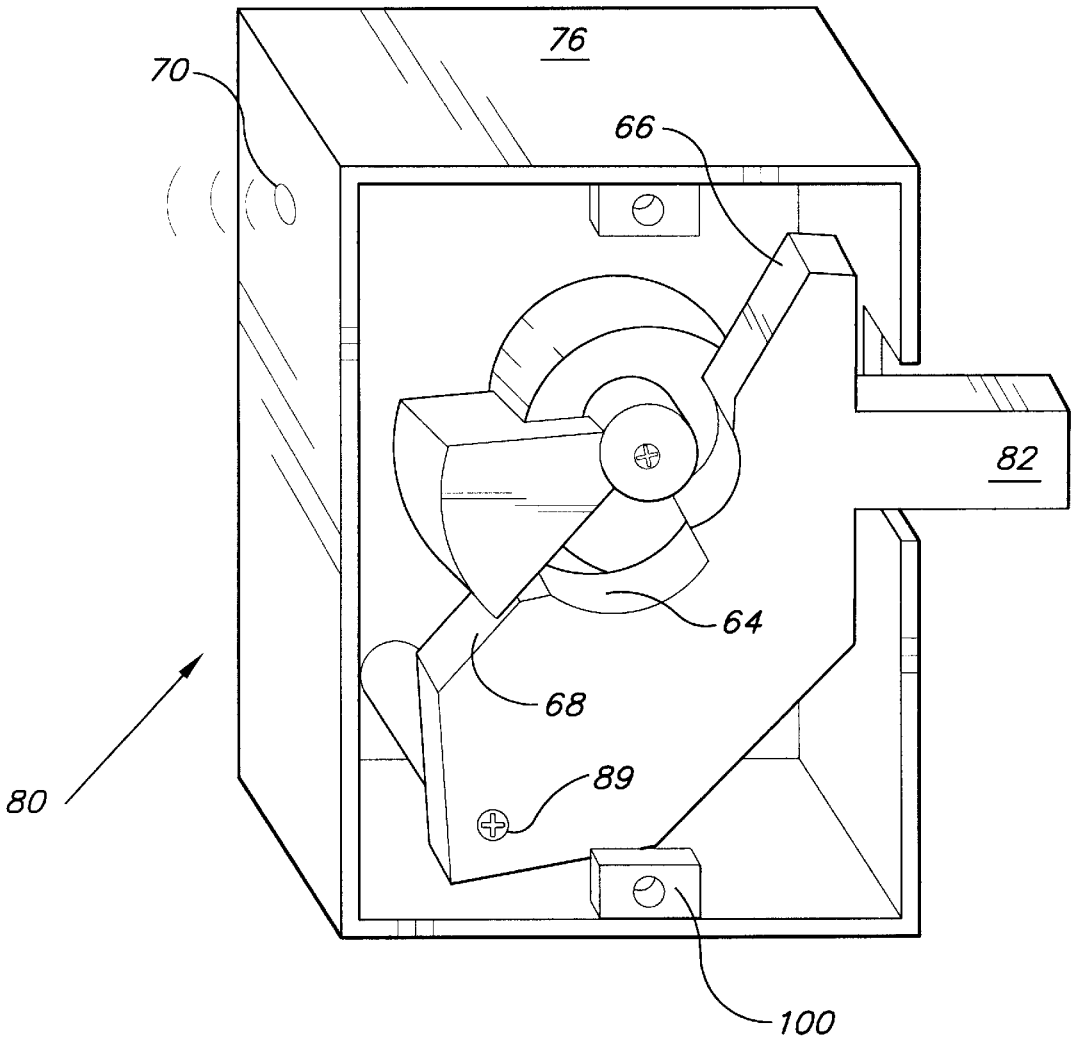
FIG. 6 is a front elevational view of the second embodiment with the locker handle raised.
Figure 7:
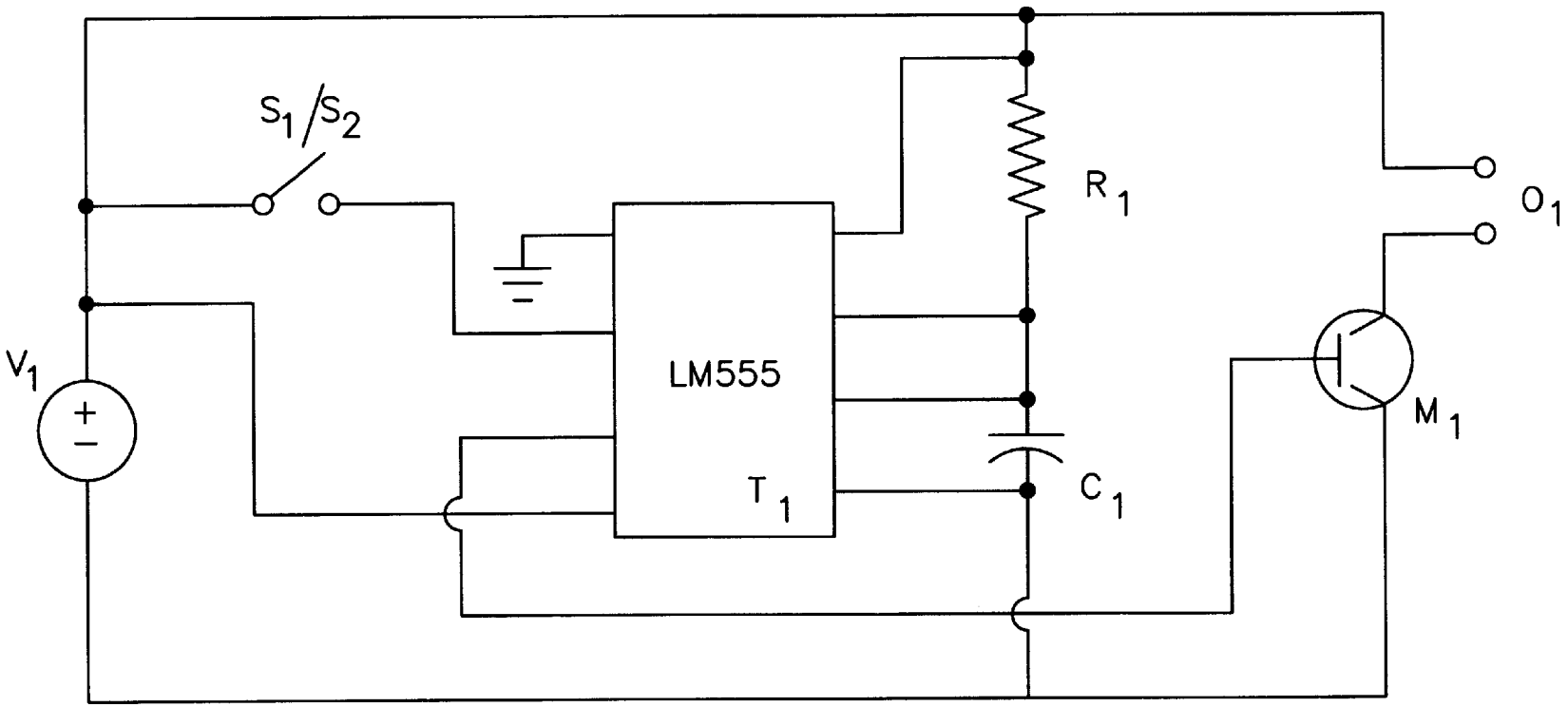
FIG. 7 is a schematic diagram of the circuit that controls the locking mechanisms of FIG. 2, and of FIGS. 4 through 6, as well as the opening mechanism of FIG. 3.
Figure 8:
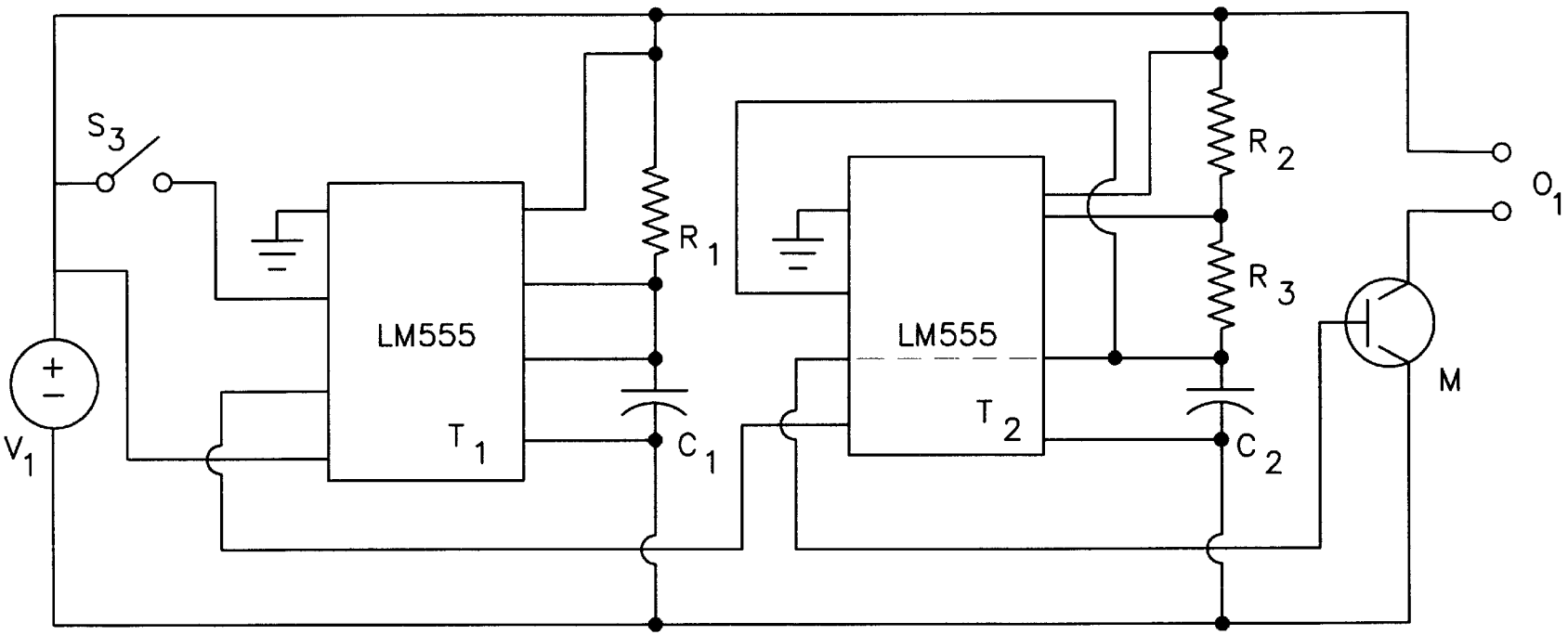
FIG. 8 is a schematic diagram of the circuit that controls the noise making device in the present invention.

The present invention is directed to a remotely control mechanism for a locker 10, especially for use by handicapped students or employees. Referring now to the drawings, FIG. 1 is a front perspective view of a school locker equipped with a generic embodiment of the present invention. FIG. 2 and FIGS. 4 through 6 show two different embodiments of a door locking mechanism, showing a locker door 16 to which is mounted enclosure 76 containing remote controlled locking mechanisms 80 and 90, respectively. FIG. 3 illustrates a remotely controlled door opening mechanism 20, as distinguished from the aforementioned locking mechanisms. Opening mechanism 20 is connected to door frame 18 of locker 10. FIG. 7 is a schematic diagram of the preferred circuit used for both the locking mechanisms (FIGS. 2 & 4), and for the opening mechanism (FIG. 3) of the present invention. FIG. 8 illustrates the preferred circuit used for a noise-making mechanism of locker 10.

Referring to FIG. 1, locker 10 includes a transmitter 40 having a plurality of buttons. The transmitter 40 and receiver may operate by radio frequency wave, infrared, or ultrasonic means. According to the preferred embodiment, a first button 50 activates locking mechanisms 80 and 90. A second button 54 activates door opening mechanism 20. A third button 58 activates a sound-making mechanism 70, much like the beeper in a wristwatch. When enabled, this device causes the lock to "beep," and it is intended to help a visually impaired student to easily find his locker. For the purposes of FIG. 2, and FIGS. 4–6, noise-making transducer 70 is illustrated diagrammatically incorporated or contained in lock enclosure 76, and has a noise-making circuit, as shown in FIG. 8, disposed within control module 60. Each automated locker 10 may have its own control module 60 and power supply. In the alternative, multiple lockers may share a power supply, or they may share a power supply and a control module. The power supply could be a battery within the control module itself, or it could be a separate stand alone unit next to the control module.

Still referring to FIG. 1, locker 10 preferably includes a receiver, or control module 60, that receives signals from transmitter 40, and provides commands that actuate either of locking mechanisms 80 or 90, or door opening mechanism 20. In general, control module 60 includes a power supply and a receiver. More specifically, the following is included in the circuitry of control module 60: (a) a receiver 61 to detect the signal of the correct transmitter 40; (b) timing circuitry, which can be adjusted to keep the door unlocked the necessary time depending upon preference; (c) diagnostic light emitting diodes (LEDs) (not shown) for trouble shooting and/or to indicate the status of the system; (d) an override switch to unlock the locker if the system stops functioning properly; and (e) control module 60 also has a mode of operation switch, including an "ON" switch 63 for permitting automatic door opening by remote control, and an "OFF" switch 65 for requiring manual door opening, that is, where the door automatically unlocks but does not automatically open.

Figure 2:
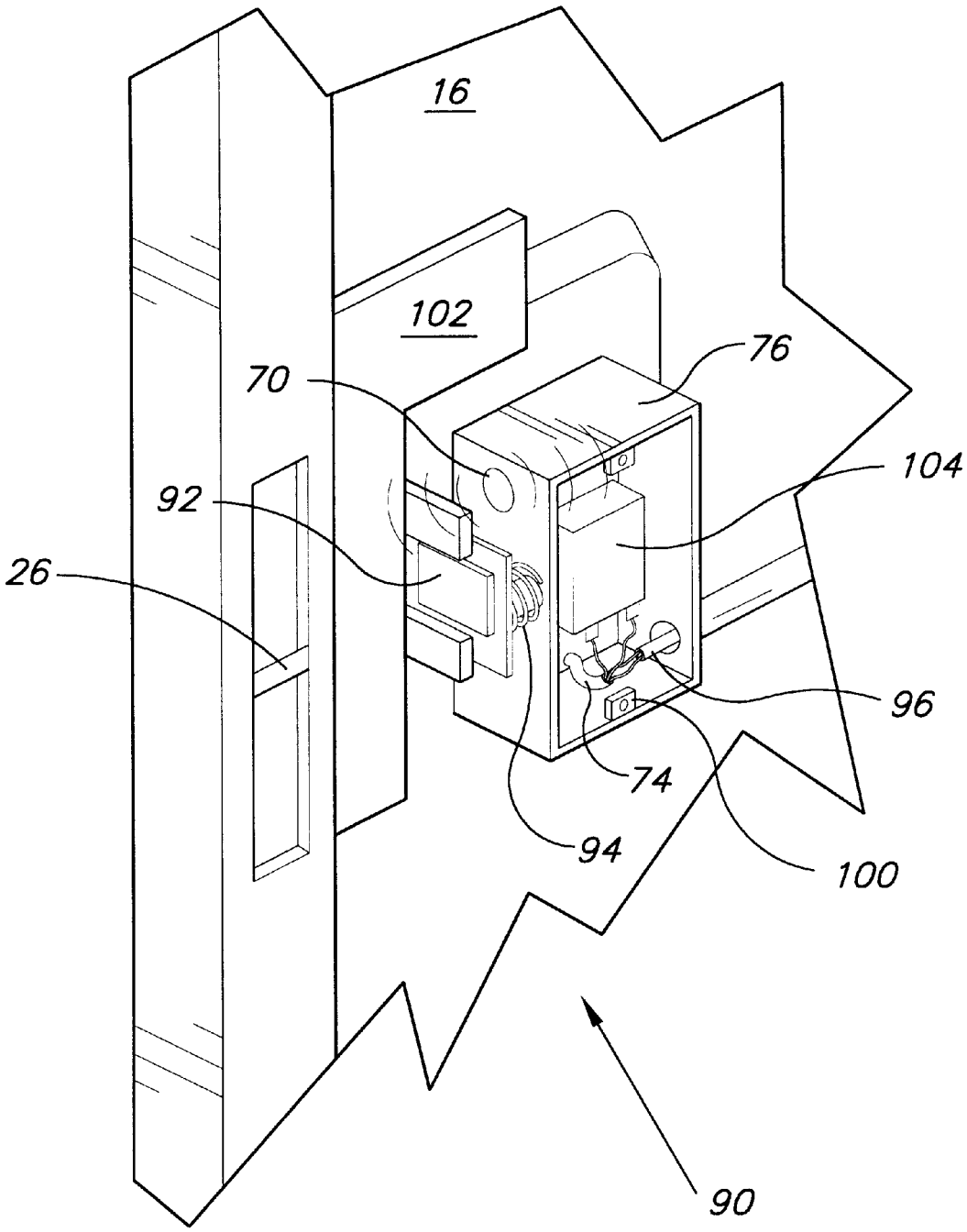
FIG. 2 is a front perspective view of the first embodiment of the automated door locking mechanism.
Figure 3:
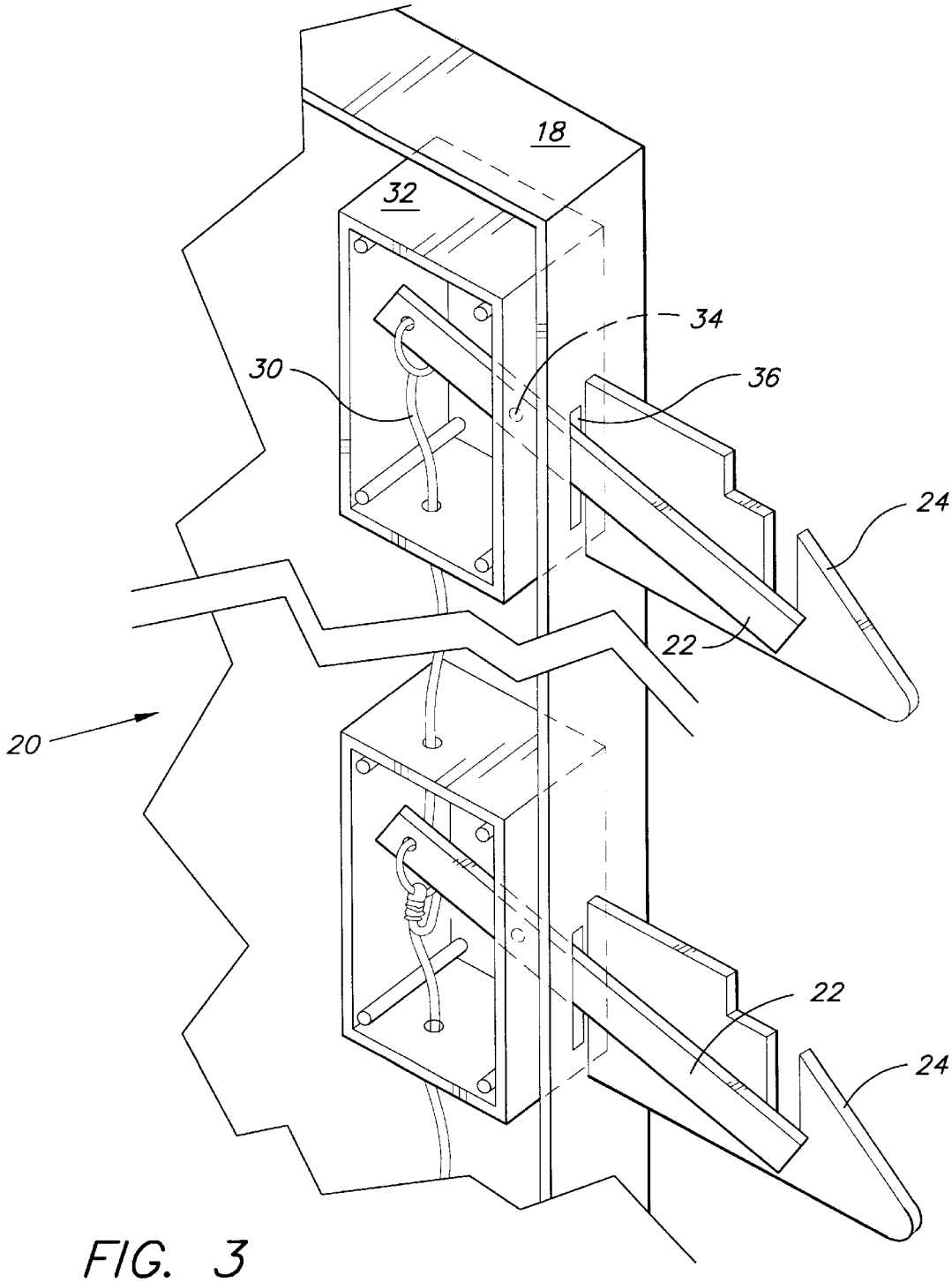
FIG. 3 is a perspective view of the automated door opening mechanism according to the present invention.

Referring to FIG. 2, enclosure attachment means 100 holds the enclosure lid onto lock enclosure 76. Plunger 92, which protrudes from enclosure 76, is a component of locking mechanism 90 that is used to prevent the opening of locker 10 by limiting the movement of latch pin release plate 102. When the correct signal is received from transmitter 40, control module 60 applies a voltage to first solenoid 104, energizing the solenoid coil and withdrawing the plunger 92 into the magnetic field of the coil, causing it to retract from release plate 102. Plate 102 can then be lifted, allowing latch pins 26 to raise and to release locker door 16. After a set amount of time, control module 60 removes voltage from solenoid 104. When power is cut, plunger spring 94 causes plunger 92 to protrude, so as to again clamp and thereby lock release plate 102 so that it may not be raised.

Solenoid 104 is preferably a standard solenoid as is well known in the industry. However, in order to make the locking mechanism battery operated, and to conserve energy, a latching solenoid or actuator may be used instead of solenoid 104. In that case, when the correct signal is received from transmitter 40, control module 60 sends a short voltage spike to the latching solenoid or actuator. This causes the device to go into a retracted state. The device remains in this state until another voltage surge is sent to it. The second surge returns the device to its initial, locked state.

As shown in FIG. 2, wire channel 74, which is attached to second locking mechanism 90, protects at least four, but up to seven wires that connect control module 60 to the locking mechanism 80 or 90 within enclosure 76. Channel 74 creates a pathway through which the wires travel from enclosure 76 in order to reach control module 60.

Still referring to FIG. 2, key switch 96 is used to power the locking mechanism on and off, and to program a new transmitter code into the system if the previous transmitter 40, or transmitter code, is lost. A new code is programmed by turning the control module 60 switch to the off position, holding down the transmitter button, and then turning the switch 96 back on.

Figure 4:
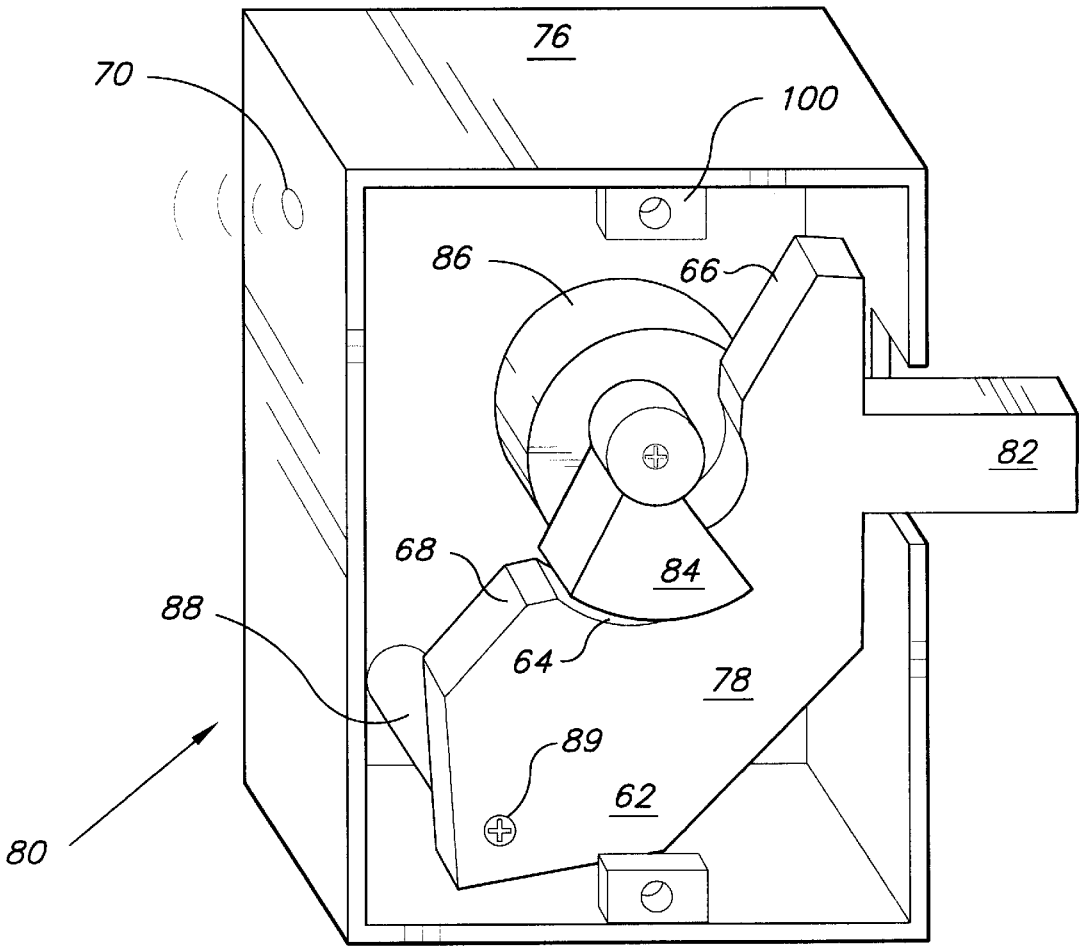
FIG. 4 is a front perspective view of a second embodiment of the automated door locking mechanism, showing the locked position.

FIG. 4 is a front perspective view of locking mechanism 80, which is an alternate embodiment of the locking mechanism shown in FIG. 2. FIGS. 4 through 6 show pendulum lock 84, of mechanism 80, in first, second, and third positions, respectively. Pendulum lock 84 is a wedge-shaped piece of steel mounted on the shaft of motor 86. FIG. 4 shows locking mechanism 80 in a locked state, with the outside edge of pendulum lock 84 facing down and seated upon, and in mating alignment with, middle seat 64 of lock body 62. Lock arm 82, which must be raised in order to open locker door 16, is a flat piece of steel that is connected to, and preferably made in one piece with, lock body 62. Body 62, together with arm 82, is fixed by standoff screw 89, which screws into standoff 88 to hold lock body 62 in place, body 62 pivoting about screw 89 within the limits set by recess 75 defined in enclosure 76. So long as pendulum lock 84 rests upon middle seat 64, lock arm 82 is held in a locked position. In order for locker 10 to be opened, it is necessary for lock arm 82 to be raised with locker handle 14. Accordingly, when the correct signal is received from transmitter 40, control module 60 sends a quick voltage surge to lock motor 86. This causes pendulum lock 84 to rotate clockwise around its axis about 180° to an unlocked position, as shown in FIG. 5. In its unlocked state, and even when no voltage is applied to motor 86, pendulum lock 84 remains upright because one of its side edges is balanced against upper seat 66 of lock body 62. With lock 84 in an unlocked state, lock arm 82 is free to move upward with locker handle 14. When locker handle 14 is then raised, pendulum lock 84 rotates counterclockwise, the shift in the center of gravity bringing pendulum lock 84 to a third resting position, as shown in FIG. 6, wherein a side edge of pendulum lock 84 rests upon lower seat 68 of lock body 62. When locker handle 14 is released, pendulum lock 84 moves to a position where it no longer rests upon lock body 62, and thus, lock 84 rotates back to the locked position shown in FIG. 4.

FIG. 3 is a side elevational view of the remotely operated automatic door opening mechanism 20, which is incorporated in both embodiments of the remote control mechanism, but used as an alternative to either of locking mechanisms 80 and 90. More precisely, door opening mechanism 20 opens door 16, independent of door unlocking mechanisms 80 or 90. The theory of mechanism 20 stems from the fact that latch pins 26 can be lifted in two different ways to open door 16. The first way, as suggested by FIG. 1, is to manually lift latch pin release plate 102 which is connected to each of the latch pins 26. The second way is to lift each individual latch pin 26. Pins 26 are held down by springs. When closing door 16, pins 26 can be lifted by the camming force upon pins 26 due to the beveled edge of each door latch 24. This is what allows locker doors to be "slammed" shut without having to lift release plate 102. Door opening mechanism 20 utilizes a method of lifting pins 26 that is closest to the "second way," described above. Mechanism 20 includes at least one latch pin release lever 22 for each of the latch pins 26. A given release lever 22 urges and slides each of pins 26 off of a latch 24. Latch 24, standard in the industry, is preferably a rigid, fixed hook, within door frame 18, that latches, in a camming relationship, onto pin 26. Latch pin 26, also standard in the industry, is a spring-loaded pin which, in conjunction with latch 24, holds locker door 16 shut. Mechanism 20 includes a second solenoid 28 which acts, through release lever cable 30, upon an end of each lever 22. Thus, when control module 60 detects the correct signal, a voltage is sent to second solenoid 28. Second solenoid 28 then pulls down on lever cable 30 causing a release lever 22 in each lever housing 32 to rotate about pivot pin 34, which acts as a fulcrum, and to thereby lift the corresponding latch pins 26 off of latches 24. This releases door 16, permitting door 16 to open. Door 16 may be biased by one or more springs (not shown) in the hinges so that the door 16 automatically swings open when pins 26 are lifted out of hooks 24. Cable 30 is preferably a steel cable running from each release lever 22 to solenoid 28. Stated more simply, cable 30 causes lever 22 to rotate about fulcrum 34 to disengage each of the pins 26 from their corresponding latch 24. Release lever housing 32 encases that portion of lever 22 that is connected to cable 30 and to fulcrum 34. The side walls of lever slot 36 of housing 32 serve to guide and to support lever 22 as it rotates about fulcrum 34. Fulcrum 34 is a pin, preferably metal or hard plastic, that is connected to a wall of housing 32.

FIG. 7 is a schematic diagram of the circuit which controls the locking mechanisms of FIG. 2, and FIGS. 4 through 6, as well as the opening mechanism of FIG. 3. The circuit shown in FIG. 7 is a timing circuit built around a timer chip T1, preferably a Motorola LM555 integrated circuit. The circuit has a power source V1 which provides direct current at an appropriate voltage, preferably twelve volts. The power source V1 may be provided by a battery or by a regulated power supply, as is known in the art. Transistor M1 is an N-channel metal oxide semiconductor field effect transistor (MOSFET) which is used to provide sufficient power, and particularly sufficient current, to energize the coil of solenoid 104 in the first embodiment of the door locking mechanism, shown in FIG. 2, the motor 86 of the second embodiment of the door locking mechanism, shown in FIGS. 4 through 6, or the solenoid 28 of the door opening mechanism, shown in FIG. 1 and common to both embodiments. The switch S1/S2 designates a trigger signal generated by pressing either button 50 or button 54 of the transmitter 40 to unlock the door or to open the door, respectively, and triggers the timer chip T1 to an "on" state. The timer chip T1 is wired for monostable (one-shot) operation in this circuit configuration, with the duration of the "on" state determined by the values of resistor R1 and capacitor C1. The output voltage is taken across the terminals O1.

When the circuit of FIG. 7 is used with the door locking mechanism of FIG. 2, R1 has a value of 432 kΩ and C1 has a value of 100 $\mu$F. This sets the duration of the "on" state at about ten seconds. Consequently, when button 50 of the transmitter 40 is pressed, the timer T1 is triggered to the "on" state and provides an output voltage at terminals O1 sufficient to cause the solenoid 104 to retract plunger 92 for ten seconds, permitting the locker handle to be raised during this period in order to open the door.

When the circuit of FIG. 7 is used with the door locking mechanism of FIGS. 4 through 6, the value of R1 is 15.65 kΩ and the value of C1 is 100 $\mu$F. This sets the duration of the "on" state at about one second. The shorter duration of the "on" state is possible in this embodiment because once the motor 86 moves the pendulum 84 to the position shown in FIG. 5, the locker 10 remains unlocked until the handle 14 is used to raise and lower the lock arm 82. In use, when button 50 is pushed, timer T1 is triggered to the "on" state for one second, providing an output voltage at terminals O1 sufficient to drive motor 86 to move pendulum 84 to the unlocked position.

When the circuit of FIG. 7 is used with the door opening mechanism of FIG. 3, R1 has a value of 15.65 kΩ and the value of C1 is 100 $\mu$F. This sets the duration of the "on" state at about one second. In use, when button 54 is pushed, timer T1 is triggered to the "on" state for one second, providing an output voltage at terminals O1 sufficient to energize the coil of solenoid 28, pulling cable 30 and lifting the latch pins 26 from hooks 24 to open the door.

FIG. 8 is a schematic diagram of the circuit that controls the noise-making device of locker 10. This circuit has some features similar to the circuit shown in FIG. 7. V1 is a power source similar to the power source shown in FIG. 7, and the same power source may be used for both circuits. The output of the circuit is taken across terminals O1, and is used to power the transducer 70. Transistor M1 is an N-channel MOSFET used to provide sufficient power to drive the transducer 70. Switch S3 receives a signal when button 58 is pressed which is used to trigger timer T1. Timer T1 is again a Motorola LM555 integrated circuit wired for monostable operation. Resistor R1 has a value of 865 kΩ and capacitor C1 has a value of 100 μF, setting the "on" state duration to a period of about thirty seconds. The circuit of FIG. 8 applies the output voltage of timer T1 to trigger a second timer T2, which is also a Motorola LM555 integrated circuit. Timer T2, however, is wired as an astable multivibrator in which the duty cycle and duration of the "on" state of timer T2 are set by the values of resistors R2 and R3, and capacitor C2. Preferred values of the resistors are 14 kΩ for R2 and 43 kΩ for R3, while capacitor C2 is preferably 100 μF. These values turn the output of timer T2 to the "on" state for one second and off for three seconds, the pattern repeating for the thirty second duration set by timer T1. In operation, when button 58 is pressed, the circuit of FIG. 8 drives the transducer 70 to beep at the rate of one second on and three seconds off for thirty seconds in order to enable the student to locate his or her locker 10.

All of the values provided for above for the components shown in FIGS. 7 and 8 are merely preferred values that are subject to preferences based upon the individual needs of the user. The signals sent by transmitter 40 to control module 60 may include, but are not limited to, RF, infrared, or sonar to open locker door 16. In some cases, it is desirable not to have the locker door actually open because the door can be opened by mistake, since control module 60 can receive a transmitted signal from a distance of up to 200 feet. Thus, if a user desires, he or she can enable locking mechanisms 80, 90, and disable opening mechanism 20. Under that option, door 16 would unlock when first button 50 is pushed, but handle 14 would have to be lifted to release, or to open door 16. Thus, the unlock and the open mechanisms will not be used simultaneously. That is, when one is enabled, the other will be disabled.

The remote control mechanism according to the present invention may be installed as an after-market modification of conventional lockers, or may be supplied as original equipment with newly manufactured lockers.

Similar reference characters denote corresponding features. It is to be understood that the present invention is not limited to the embodiments described above, but encompasses any and all embodiments within the scope of the following claims.

I claim:

1. A remote control mechanism for a locker, comprising:

a transmitter having a first button for transmitting a first signal and a second button for transmitting a second signal;

a control module having a receiver for receiving a plurality of signals generated by said transmitter;

a door lock means unlocking a door of a locker when said receiver receives said first signal; and a door opening means for opening a door of a locker when said receiver receives said second signal.

2. The remote control mechanism according to claim 1, wherein said transmitter further comprises a third button which transmits a third signal, the remote control mechanism further comprising a noise-making means for producing an audible signal for locating a locker when said receiver receives the third signal.

3. The remote control mechanism according to claim 1, wherein said door lock means comprises:

a) a timer circuit electrically connected to said receiver, the timer circuit having an on state of predetermined duration triggered when said receiver receives said first signal;

b) a solenoid having a plunger, the solenoid being adapted for attachment to a locker having a lock release plate, the plunger normally being in an extended position for clamping the lock release plate in a locked position; and c) wherein said solenoid is electrically connected to said timer circuit so that when said receiver receives said first signal, said timer circuit energizes said solenoid to retract said plunge in order to allow the lock release plate to be moved to an unlocked position.

4. The remote control mechanism according to claim 1, wherein said door lock means comprises:

a) a timer circuit electrically connected to said receiver, the timer circuit having an on state of predetermined duration triggered when said receiver receives said first signal;

b) a motor having a shaft, the motor being electrically connected to said timer circuit;

c) a pendulum lock having a wedge-shaped body, the pendulum lock being mounted on the shaft of said motor;

d) a lock enclosure housing said motor and pendulum lock, the enclosure having an opening defined therein, the enclosure being adapted for attachment to a locker door;

e) a lock body having an upper seat, a middle seat and a lower seat and having a lock arm extending from the lock body into the opening defined in said enclosure, said the lock arm being adapted for attachment to a locker handle which raises and lowers the lock arm within the limits of the opening defined in said enclosure; and f) wherein said timing circuit activates said motor when in the on state to rotate said pendulum lock between a locked position in which the pendulum lock abuts the middle seat so that said lock arm may not be raised, and an unlocked position in which said pendulum lock abuts said upper seat in which said lock arm may be raised, said pendulum lock rotating by gravity to a rest position in which said pendulum lock abuts the lower seat when said lock arm is raised, said pendulum lock further rotating by gravity to the locked position when said lock arm is lowered.

5. The remote control mechanism according to claim 1, wherein said door opening means comprises:

a) a timer circuit electrically connected to said receiver, the timer circuit having an on state of predetermined duration triggered when said receiver receives said second signal;

b) a solenoid adapted for attachment to a locker;

c) a release lever cable having a first end affixed to said solenoid;

d) at least one latch pin release lever having a first end attached to said release lever cable and having a free second end, said release lever being adapted for pivotal attachment to a locker frame adjacent a latch hook receiving a spring-biased latch pin on a locker door, the locker door being spring-biased to open when the latch pin is raised from engagement with the hook; and e) wherein said solenoid receives a voltage when said timer circuit is in the on state, said voltage activating said solenoid to pull said release lever cable in order to raise the second end of said latch pin release lever, the second end being adapted for lifting the latch pin from engagement with the latch hook when the second end is raised in order to open the locker door.

6. The remote control mechanism according to claim 2, wherein said noise-making means comprises:

a) a transducer adapted for attachment to a locker;

b) a timer circuit electrically connected to said receiver, the timer circuit having an on state of predetermined duration triggered when said receiver receives said third signal; and c) an astable multivibrator electrically connected to said transducer and to said timer circuit, the astable multivibrator supplying a voltage for turning said transducer on and off for a predetermined duty cycle when said timer circuit is in the one state in order to provide an audible signal for locating the locker.

* * * * *